United States Patent [19]

Jacoby

[11] 4,084,157

[45] Apr. 11, 1978

[54] SMOKE AND HEAT DETECTOR ALARM

[76] Inventor: Sidney Jacoby, 1901 Kennedy Bldg., Philadelphia, Pa. 19103

[21] Appl. No.: 647,329

[22] Filed: Jan. 8, 1976

Related U.S. Application Data

[63] Continuation-in-part of Ser. No. 478,928, Jun. 13, 1974, Pat. No. 3,938,115.

[51] Int. Cl.[2] ..... G08B 17/04; G08B 17/10

[52] U.S. Cl. ..... 340/237 S; 116/106; 116/137 R; 340/229

[58] Field of Search ..... 340/237 S, 229; 116/5, 116/65, 101, 106, 108, 114.5, 137 R, 139

[56] References Cited

U.S. PATENT DOCUMENTS

| | | | |
|---|---|---|---|
| 3,391,367 | 7/1968 | Messick | 116/65 X |
| 3,938,115 | 2/1976 | Jacoby | 340/237 S |

*Primary Examiner*—John W. Caldwell, Sr.
*Assistant Examiner*—Daniel Myer
*Attorney, Agent, or Firm*—Weiser, Stapler & Spivak

[57] ABSTRACT

A smoke and heat detector alarm including a compressed gas, self contained, stored energy source. A T-fitting connects to the compressed gas tank through a fusible element activated valve and feeds separate conduit systems leading to individual sounding devices. One of the conduit systems receives compressed gas directly from the valve to automatically permit transfer of the compressed gas to a first sounding device upon the presence of elevated temperatures sufficient to fuse the fusible element. The valve includes a lever arm that is functioned by operation of the fusible element to trigger an additional electrical alarm circuit. A solenoid operated switch is interposed in the other conduit system to normally prevent the flow of gas. The solenoid is responsive to a smoke detector and is wired to open the solenoid valve upon sensing the presence of a predetermined concentration of smoke to permit transfer of the compressed gas to a second sounding device.

9 Claims, 2 Drawing Figures

SMOKE AND HEAT DETECTOR ALARM

BACKGROUND OF THE INVENTION

This is a continuation in part of my co-pending application Ser. No. 478,928 filed June 13, 1974 now U.S. Pat. No. 3,938,115, entitled "Combination Smoke and Heat Detector Alarm".

The present invention relates generally to the field of alarm devices and more particularly, is directed to a smoke and heat detector alarm system which is equally responsive to either the presence of heat or to the presence of smoke, and which includes both electrical and compressed gas operated alarm sounding devices.

The general premise of the need for protecting occupants of buildings from the danger of fire has long been a building design concept and many types of electrically operated and mechanically operated fire alarm systems have been developed by prior workers in the field. The prior art types of fire alarm systems have varied greatly in reliability, complexity, scope, cost and in the basic protection features afforded by each particular type of design. Additionally, distinctions have traditionally been made between alarm systems suitable for commercial and industrial establishments, and in alarm systems particularly designed for residential use.

Alarm systems such as manual fire alarms, automatic fire alarms, central station connected systems, local supervisory alarm systems, coded and non-coded alarm systems, sprinkler alarm systems and others have been developed for particular applications in specified occupancies. It will be appreciated that the initial cost both in basic equipment price and in the cost of installation varies widely between the different systems available. The safety and reliability features offered by the various systems also are widely divergent. Accordingly, the selection and design of an alarm system when planning a new building or when installing an alarm system in an existing building forms an important design decision dependent upon such factors as the type of occupancy, the type of building construction, the number of persons to be protected, the equipment cost factor, etc.

More recently, tests have been conducted and investigations have been made of actual fires wherein it has been determined that in many instances, the buildings subject to fire became untenable from smoke long before they are untenable due to the elevated temperatures of a fire. Because of this added awareness, much thought has been given recently to personnel protection in buildings. In accordance with these recent studies, safety from smoke considerations now form an important building design parameter. Numerous smoke detection devices have been developed to a degree wherein they are quite reliable and are now in general use. The prior art smoke detection systems have, until now, been employed usually to trigger alarm systems in commercial and apartment buildings upon presence of smoke to thereby warn the building occupants. Because of the added awareness of the dangers inherent in residential fires, many self contained, single station, relatively inexpensive units have been specifically designed for residential use in an attempt to reduce the number of fatalities resulting from residential fires. Such units have traditionally incorporated a sounding device in the form of a bell or horn and a detecting device which was either responsive to the presence of smoke or to the presence of heat.

There are many reported instances wherein a relatively smoky fire did not generate sufficient heat to actuate a heat-actuated alarm until it was too late to warn the building occupants of the presence of deadly smoke. Other instances have been documented wherein the heat of a fire builds up so quickly as to render a building untenable from heat before sufficient quantities of smoke are generated to activate a usual smoke detection device. Existing smoke detector systems have sometimes failed to properly function when the electrical power required for operation was interrupted by action of the fire itself. Other smoke detector systems have proved deficient to a degree in that the associated alarm device of existing single station units cannot develop sound levels above 93 DBa. Accordingly, a single station unit which incorporates a sounding device capable of emitting alarm signals of greater intensity and which can be actuated both by a heat actuated device and by a smoke actuated device would be most desirable. Another combination unit incorporating both an electrical powered alarm sounding device and a compressed gas powered alarm sounding device would also be desirable. Heretofore, no such combination unit has been made available for public use.

SUMMARY OF THE INVENTION

This invention relates generally to the field of alarm systems, and more particularly, is directed to a self-contained alarm system that is equally responsive to the presence of smoke and to the presence of heat to function both a compressed gas powered horn and an electrically power buzzer alarm.

The alarm device of the present invention includes a self contained energy source which may be in the form of a conventional compressed gas tank containing an easily compressed gas in liquid form such as "Freon" gas. A lever controlled valve connects to the gas tank outlet and feeds two separate gas conduit systems, each system of which leads to a separate sounding device, such as gas operated horn of the type capable of producing an alarm signal of 115DBa. A heat sensitive, fusible element is employed to normally retain the valve lever in the closed position. One of the gas conduit systems receives directly gas from the valve when the lever is released upon fusing of the fusible element which is designed to melt at a predetermined elevated temperature, for example, 136° F. or 174° F., depending upon the predetermined conditions of use. Interposed in the second gas conduit system is a conventional solenoid operated valve which is normally closed but which may be moved to its open position upon triggering of a self contained smoke detection device. The smoke detection device may be of any well known, approved type such as a photoelectric cell smoke detector or an ionization products of cumbustion smoke detector. Thus, the combination smoke and heat detector of the present invention is completely self contained and is equally responsive both to the presence of the predetermined elevated temperature and to the presence of a sufficient concentration of smoke. The smoke detection device also includes an electrical buzzer and an electrical circuit which is normally open. Release of the valve lever upon melting of the fusible element causes the electrical circuit to close to thereby function an electrical alarm signal such as a buzzer.

It is therefore an object of the present invention to provide an improved smoke and heat detector alarm of the type set forth.

It is another object of the present invention to provide a novel smoke and heat detector alarm which includes in combination a self contained source of energy and three sounding devices, one sounding device being responsive to the presence of heat, the second sounding device being responsive to the presence of smoke and the third sounding device being responsive to the presence of heat and being powered by a source of energy that is different from the energy source of the first and second sounding devices.

It is another object of the present invention to provide a novel smoke and heat detector alarm that is completely self contained, that includes a single gas tank to function a first horn upon presence of elevated temperatures and a second horn upon presence of a predetermined concentration of smoke and further includes an electrical alarm device and means to activate the alarm device upon the detection of elevated temperatures.

It is another object of the invention to provide a novel smoke and heat detector alarm system which incorporates an independent, mechanically operated heat detector and an independent, electrically operated smoke detector wherein the heat detector is not effected by possible electrical failure of the smoke detector.

It is another object of the present invention to provide a novel smoke and heat detector alarm system which is capable of generating an alarm signal in the smoke detector portion of greater intensity than heretofore possible.

It is another object of the present invention to provide a novel smoke and heat detector alarm system that is capable of responding to either the presence of heat or the presence of smoke and that is further capable of sounding both a mechanical powered alarm device and an electrically powered alarm device.

It is another object of the present invention to provide a novel smoke and heat detector alarm that is simple in design, inexpensive in manufacture and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
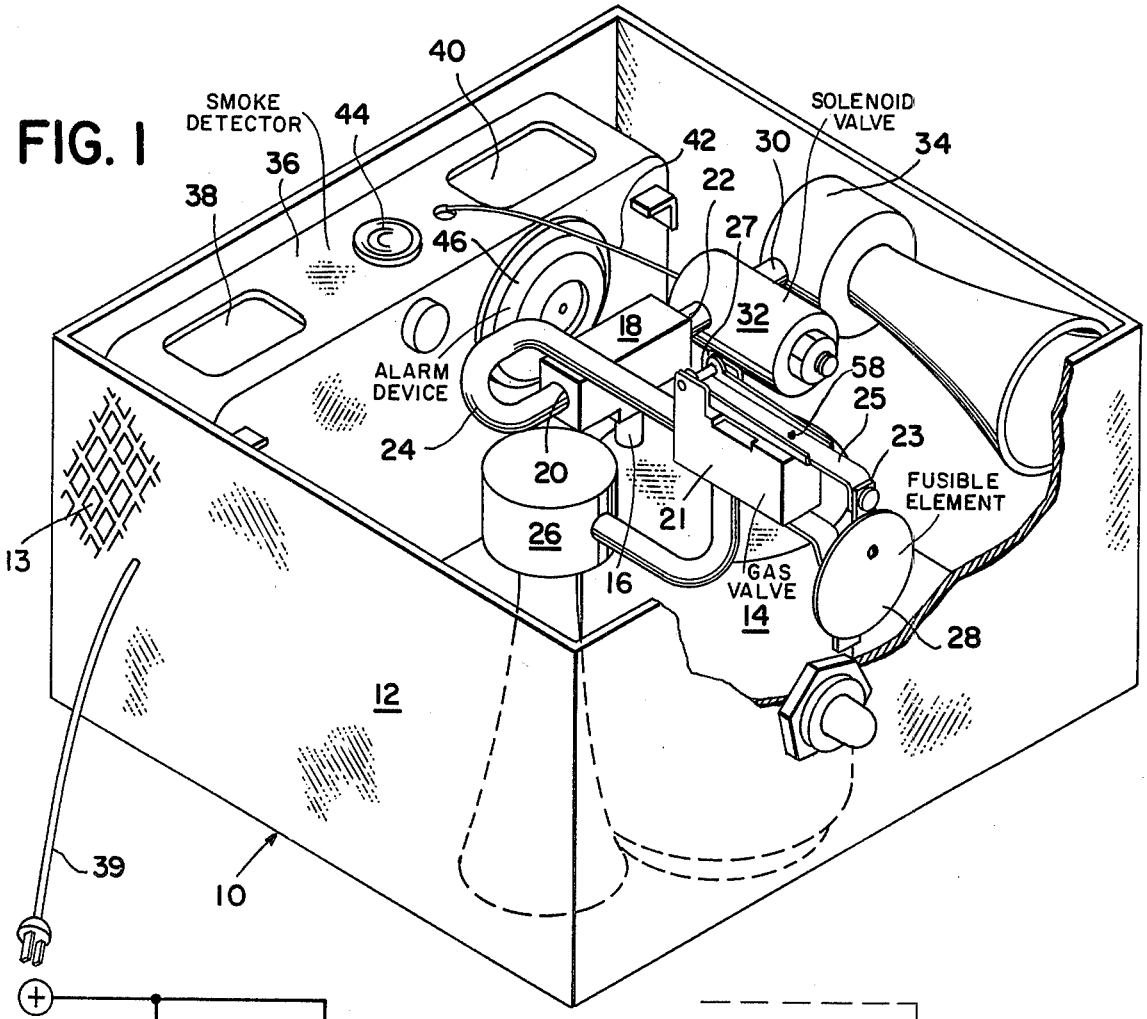
FIG. 1 is a rear perspective view of the invention with the rear cover removed and partially broken away to expose details of interior construction.

Although specific terms are used in the following description for the sake of clarity, these terms are intended to refer only to the particular structure of my invention selected for illustration in the drawings, and are not intended to define or limit the scope of the invention.

Referring now to the drawing, I show in FIG. 1 a smoke and heat detector alarm system 10 of the self-contained type wherein most of the component parts are mounted within an enclosing cabinet 12. The cabinet 12 is preferably fabricated of metal or other suitable strong material. An open area 13 of metal mesh or similar open construction permits ambient air to easily reach the smoke detector 36. Thus, the products of combustion (if present) can readily reach the smoke detector 36 which is installed within the cabinet 12. Elevated temperatures caused by a fire directly impinge upon a heat responsive fusible element 28 which is mounted exteriorly of the cabinet 12.

A first source of energy, which preferably is in the form of a compressed gas tank 14 stores a quantity of liquefied, easily compressed gas (not shown) which preferably is liquefied "Freon". The gas tank 14 is provided with a threaded outlet 16 which is utilized both for cylinder filling purposes prior to installation and to permit the exit of gas therefrom upon the detection of smoke or heat in the manner hereinafter more fully set forth. A threaded fitting 18 of generally T-shaped configuration communicates with the outlet 16 to receive gas from the interior of the gas tank 14. Gas exits the fitting 18 through the left side opening 20 and the right side opening 22 upon actuation of a detecting device to power the sounding devices 26, 34 as hereinafter more fully set forth.

A first gas conduit system 24 leads from the left side opening 20 of the threaded fitting 18, through the lever activated gas valve 21 and connects at its other end to a first horn 26 or other suitable sounding device. A heat sensitive fusible element disk 28 which includes a connector 23 secured by a eutectic alloy designed to melt at a predetermined temperature, for example 136° F. or 174° F., is mounted exteriorly of the cabinet 12 to detect the presence of heat in the vicinity of the alarm system 10. Upon detecting the presence of temperature sufficiently elevated to activate the device, the eutectic alloy of the fusible element 28 will melt to release the activating lever 25 of the gas valve 21 to thereby open the first gas conduit system 24 to permit the flow of gas from within the tank 14 to the gas valve 21, through the threaded T fitting 18, through the first gas conduit system 24 and into the horn 26 for alarm sounding purposes.

A second gas conduit system 30 connects to the right side opening 22 of the T fitting 18 and leads through the solenoid operated valve 32 to a second gas operated horn 34. The solenoid operated valve 32 is movable from a closed position wherein no gas can flow from the tank 14 through the second gas conduit system 30 to an open position wherein gas freely flows from the compressed gas tank 14 through the solenoid operated valve 32 to the second horn 34 for alarm sounding purposes. The solenoid may be any suitable gas type solenoid valve such as the valve manufactured by Skinner Precision Industries, Inc., New Britain, Conn. rated for 110 volt, 6 watt service.

A smoke detector 36 of approved design such as a photoelectric smoke detector or an ionization products of combustion detector is mounted within the cabinet 12 and has its sampling air inlets 38, 40 conveniently positioned to continuously sample the ambient air. Electrical energy to power the smoke detector may be supplied through a conventional electrical cord 39 which can be connected to a usual source of 110 volt electrical current in well known manner. The smoke detector 36 should be of suitable type to close a relay or comparable device (not shown) to energize an electrical circuit 42 for solenoid valve 32 operation purposes as hereinafter more fully set forth. One detector that has been found suitable for this purpose is Model Al-711 as manufactured by Algenik Industries, Inc., Fort Lauderdale Fla. as listed and approved by Underwriter's Laboratories, Inc. This particular smoke detector 36 also includes a separate heat detector 44 and alarm sounding device 46. The heat detector 44 is normally not employed as an operative feature of the present invention.

Upon detection of a predetermined density or concentration of smoke in the ambient atmosphere in accordance with recognized standards, such as the standards prepared by Underwriters'Laboratories, Inc. and the American Society for Testing and Materials, the smoke detector 36 will function to trigger a device such as a relay, semi conductor switch or similar device (not shown) which acts to energize the electrical circuit 42. The circuit 42 functions the solenoid operated valve 32 to thereby open the second gas conduit system 30 to expose the second horn 34 to the gaseous contents retained under pressure within the compressed gas tank 14. The passage of the gas (not shown) from the cylinder 14 through the second horn 34 activates the horn to thereby render the second horn 34 directly responsive to the presence of smoke as detected by the smoke detector 36. Thus, it is seen that the first horn 26 is responsive to the presence of heat as controlled by the fusible element 28 and the second horn 34 is directly responsive to the presence of a concentration of smoke as controlled by the solenoid operated valve 32 upon function of the smoke detector 36.

It will be appreciated that the fitting 18 simultaneously pressurizes the first gas conduit system 24 and the second gas conduit system 30 by exposing both gas conduit systems to the gaseous contents of the compressed gas tank 14. In this manner, either the system 24 or the system 30 can be activated upon sensing respectively the presence of a sufficient concentration of smoke or of a predetermined elevated temperature. Should a fire develop and generate sufficient quantities of smoke and sufficient elevated temperatures to activate both the smoke detector 36 and the fusible element 28, then both horns 26, 34 will be simultaneously activated to thereby generate an alarm sound of much greater intensity than that possible from only a single sounding device. Thus, as a fire develops intensity, the single unit 10 is designed to greatly increase the alarm intensity capabilities.

For example, by employing the applicable Underwriters' Laboratories, Inc. test procedures, a single horn 26 was activated and a generated sound in the range of 115 DBa was noted. Then the second horn 34 was simultaneously activated and readings in the range of 118–120 DBa resulted. As set forth in a publication entitled "Household Fire Warning Equipment Spot Type Detectors", published by Fire Equipment Manufacturers Association (DEMA), May 1974, Page 12, each increase of one decibel is equal to an effective increase in intensity of sound of 26 percent.

Figure 2:
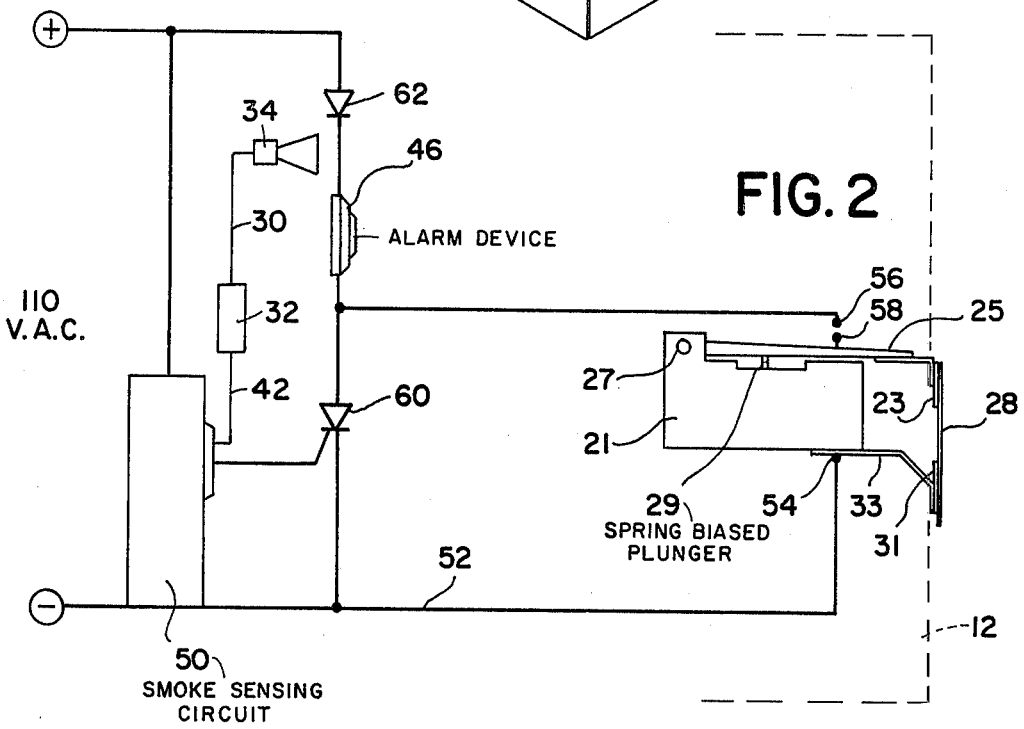
FIG. 2 is a schematic diagram showing the electrical circuit to activate an electrically powered alarm device and wherein portions of the enclosing cabinet have been shown in dotted lines for purposes of association.

As illustrated in FIGS. 1 and 2, the gas valve 21 includes a pivotally connected operating lever 25 which is upwardly pivotal about the pivot pin 27. A spring biased plunger 29 normally urges the lever 25 upwardly. The fusible element 28 includes a fusibly attached connector 23 and a soldered connector 31 which is not responsive to the presence of heat or smoke. The connector 23 is affixed to the disk by a eutectic solder designed to melt at a predetermined elevated temperature, for example, 136° F. The connectors 23, 31 of the fusible element connect to the valve 21 between the pivotal operating lever 25 and the fixed arm 33. Under normal conditions, the fusible element maintains the valve 21 closed by restraining the operating lever and depressing the plunger 29 to thus prevent flow of gas through the conduit system 24 to the gas operated horn 26. Should elevated temperatures be detected, the eutectic alloy solder will fuse to release the connector 23 and also the operating lever 25. The plunger spring will pivot the lever 25 about the pivot pin 27 and raise the plunger 29 to thereby open the valve 21 and function the gas powered horn 26.

The activation of the valve 21 also serves to trigger an electrically powered alarm device 46 which may be the integral buzzer connected in the sensing circuit 50 of the smoke detector 36. As illustrated in FIG. 2, an electrical circuit 52 extends from the smoke sensing circuit 50 and has one terminal 54 electrically interconnected with the valve 21 in a manner to allow the valve 21 to also serve as an electrical switch. Another terminal 56 of the circuit 52 terminates near the operating lever 25 and in spaced relationship thereto. The lever 25 is equipped with a contact 58 which is positioned to engage the circuit contact 56 when the arm 25 is released. Thus, when the operating arm 25 is freed upon fusing of the eutectic alloy solder of the fusible element 28, the plunger 29 forces the operating lever 25 pivotally about the pin 27 until the arm contact 58 engages the circuit contact 56 to thereby close the electrical circuit 52. The closing of the circuit 52 causes current to flow to electrically power the sounding device 46. It will be noted that operation in this mode will energize the buzzer 46 regardless of the condition of the smoke sensing circuit 50.

The circuit 52 including the switch 21 effectively serves to by-pass the silicon controlled rectifier 60 which is normally employed with the existing sensing circuit 50 of the photoelectric smoke detector 36. The SCR 60 normally is utilized as the firing circuit for activating the alarm device 46 upon the sensing of smoke. This function is not interrupted by the circuit 52. Rather, the circuit 52 and the valve 21 serve to additionally activate the sounding device 46 upon sensing the presence of elevated temperatures at the fusible element 28. The diode 62 exists in the sensing circuit 50 of the smoke detector 36 and is utilized in the invention in the same manner as in the smoke detector 36 alone to compensate for the back emf developed by the operation of the sounding device 46.

Although I have described the present invention with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

I claim:

1. In a smoke and heat detector alarm, the combination of (A) a first, self contained source of energy, (1) said source including an energy outlet;

(B) a first conduit system communicating with the outlet, (1) said first conduit system comprising a first sounding device and a first valve means to regulate the flow of energy from the source to the first sounding device, (a) said first valve means being movable from a closed condition to an open condition upon sensing a predetermined elevated temperature in the vicinity of the alarm to open the first conduit system and to activate the first sound device, (b) said first valve means comprising an electrically conductive body and an electrically interconnected operating lever, said lever being movable from a first position to a second position to function the first valve means to the said conditions respectively, (c) said first valve means further comprising a fusible element, said element being adapted to normally restrain the operating lever to the said first position, (d) said first valve means further comprising means to move the operating lever upon fusing of the fusible element; and (C) a second sounding device powered by a second, electrical source of energy, (1) said second source including an electrical circuit and a circuit open means comprising a pair of spaced contacts to prevent energy flow to the second sounding device, (2) the said space between the contacts being closed by a portion of the first valve means when the first valve means is moved to the open condition to activate the second sounding device.

2. The alarm of claim 1 wherein the first source of energy is a compressed gas.

3. The alarm of claim 1 wherein the means to move comprise a spring biased plunger and a pivotal interconnection between the operating lever and the body.

4. The alarm of claim 1 wherein the operating lever and body are electrically interconnected in the circuit when the first valve means is moved to the said open condition upon fusing of the fusible element.

5. The alarm of claim 1 and a second conduit system communicating with the said energy outlet, said second conduit system including a third sounding device, a second valve means to control the flow of energy from the first source to the third sounding device and a smoke detector means to control the second valve means wherein the second valve means is opened in response to and upon sensing the presence of a predetermined quantity of smoke.

6. The alarm of claim 5 wherein the second valve means comprises a solenoid operated valve, said valve being normally closed to prevent the flow of energy through the second conduit system, said valve being opened by the smoke detector means upon detection of the predetermined concentration of smoke.

7. The alarm of claim 6 and a fitting attached to the outlet, said fitting having a single inlet connection to receive compressed gas from the outlet, said fitting having a first outlet connection to the first conduit system and a second outlet connection to the second conduit system, the first valve means being interconnected between the fitting first outlet connection and the first sounding device and the second valve means being interconnected between the fitting second outlet connection and the third sounding device.

8. The alarm of claim 5 wherein the first and third sounding devices are gas operated horns.

9. The alarm of claim 5 and an enclosing cabinet, said first source of energy, the first and third sounding devices, the second conduit system are contained within the cabinet, and wherein the fusible element portion of the first valve means is mounted exteriorly of the cabinet.

* * * * *